US007771247B2

(12) United States Patent
Kessler

(10) Patent No.: US 7,771,247 B2
(45) Date of Patent: Aug. 10, 2010

(54) NOVELTY LIGHT-UP TOY

(76) Inventor: Brian D. Kessler, c/o Maui Toys, Inc., 11788 W. Pico Blvd., Los Angeles, CA (US) 90064-1149

( * ) Notice: Subject to any disclaimer, the term of this patent is extended or adjusted under 35 U.S.C. 154(b) by 1059 days.

(21) Appl. No.: 11/440,451

(22) Filed: May 25, 2006

(65) Prior Publication Data

US 2006/0270309 A1 Nov. 30, 2006

Related U.S. Application Data

(60) Provisional application No. 60/684,208, filed on May 25, 2005.

(51) Int. Cl.
*A63H 1/24* (2006.01)

(52) U.S. Cl. ..... 446/242; 446/236; 446/266

(58) Field of Classification Search ..... None
See application file for complete search history.

(56) References Cited

U.S. PATENT DOCUMENTS

| | | | | |
|---|---|---|---|---|
| 4,338,547 | A | 7/1982 | McCaslin | |
| 4,713,039 | A | 12/1987 | Wong | |
| 5,105,343 | A | 4/1992 | Wakimoto | |
| 5,157,217 | A * | 10/1992 | Feng | 84/95.2 |
| 5,190,491 | A | 3/1993 | Connelly | |
| 5,422,796 | A | 6/1995 | Peebles et al. | |
| 5,474,482 | A | 12/1995 | Davidson | |
| 5,502,908 | A | 4/1996 | Powell et al. | |
| 5,919,078 | A | 7/1999 | Cassidy | |
| 6,196,693 | B1 | 3/2001 | Glynn | |
| 6,282,820 | B1 | 9/2001 | White et al. | |
| 6,357,151 | B1 | 3/2002 | Yuen | |
| 6,413,144 | B1 | 7/2002 | Williams | |
| 6,589,094 | B2 * | 7/2003 | Spencer | 446/242 |
| 6,592,423 | B1 * | 7/2003 | Boyle et al. | 446/175 |
| D504,706 | S * | 5/2005 | Bennett | D21/398 |
| 7,065,908 | B1 | 6/2006 | Pineda-Sanchez et al. | |
| 7,179,149 | B2 * | 2/2007 | Chernick et al. | 446/242 |
| 7,361,074 | B1 * | 4/2008 | Periman et al. | 446/242 |
| 2002/0068505 | A1 | 6/2002 | Williams | |

(Continued)

FOREIGN PATENT DOCUMENTS

JP 2003181159 A * 7/2003

OTHER PUBLICATIONS

Copending U.S. Appl. No. 12/274,905.

*Primary Examiner*—Ronald Laneau
*Assistant Examiner*—Tramar Harper
(74) *Attorney, Agent, or Firm*—Browdy and Neimark, PLLC

(57) ABSTRACT

A hand-held light-up toy including a see-through housing, a handle connected to the see-through housing, a light source assembly rotatably mounted within the see-through housing, the light source assembly comprising a housing and a printed circuit board mounted within the housing, a plurality of light sources mounted on the printed circuit board, a power source disposed within the handle, motor disposed within the handle and connected to the power source, having a motor shaft extending therefrom, a rotation means disposed within the handle and connected to the motor shaft, and to the printed circuit board assembly for rotating the printed circuit board assembly when the motor is turned on, and an on/off switch assessable on the handle for selectively activating the power source and the motor.

13 Claims, 9 Drawing Sheets

U.S. PATENT DOCUMENTS

2005/0052863 A1* 3/2005 Kim et al. ..... 362/232
2006/0111011 A1 5/2006 Wang
2006/0128258 A1 6/2006 Zebert et al.
2006/0283062 A1 12/2006 Moomaw
2007/0207700 A1 9/2007 Ellis

* cited by examiner

NOVELTY LIGHT-UP TOY

RELATED APPLICATIONS

The present application claims priority to provisional application No. 60/684,208 filed May 25, 2005, the entirety of which is incorporated by reference herein.

FIELD OF THE INVENTION

The present invention relates to a novelty light-up toy which includes a plurality of rotating illumination sources, which form a variety of light patterns during operation.

BACKGROUND

There are known types of novelty items or toys that have lights that spin and are selectively turned on and off in patterns. For example, U.S. Published Application No. U.S. 2004/0004828 to Chernick et al. discloses a spinning, illuminated novelty device. More specifically, the device includes a handle supporting a flexible hub 14, the hub having at least one radially extending flexible arm 16. Disposed upon the flexible arm is at least one array of lights 20 (preferably light emitting diodes) on circuit boards 21. When the arms rotate, the lights in the array rotate about the hub in a variety of circular pathways producing changing patterns of light. A rotatable control circuit mounted on circuit board 32 within the hub is coupled to the lights, and selectively flashes the lights in a manner synchronous to the speed at which they rotate to produce a desired changing pattern of lights. Preferably, the arms are made of a flexible material such as foam rubber, synthetic rubber, or silicone. The array of lights disposed on the arms may comprise a line or matrix of light emitting diodes. FIG. 3, for example, shows two opposite arms, each arm having 5 light emitting diodes thereon.

U.S. Pat. No. 5,190,491 to Connelly discloses an animated paddle 10 comprised of a handle 12 and a paddle body 14 rotationally mounted thereto. The paddle includes an outer shell protecting an interior PCB 37. The PCB is electrically connected to batteries and lights (preferably light emitting diodes), wherein the lights are mounted upon the surface of the paddle. When the toy is activated, the LEDs illuminate according to a predetermined pattern, stored in a ROM within the paddle.

Peebles et al., in U.S. Pat. No. 5,433,796, provide for a light twirler wand comprised of a central, hand-grip portion 12 housing batteries, motors, switches, and an electrical power transfer device 22. Additionally, the wand includes a series of rotating lighted arms 18, 34 at one or both ends of the central portion. The lighted arms may include lights merely at the protruding tip of each arm, or the arms may be equipped with several lights along their entire length.

U.S. Pat. No. 4,713,039 to Wong discloses a battery-powered, gyroscopic toy comprising a motor rotated flywheel 24 within a domed housing 32. Protruding from beneath the domed housing is a tubular housing 12 with noise generators and flashing lights controlled by a centrifugal switch. The toy may be spun on either the top of the dome or the bottom of the tubular portion. When the housing rotates, small lights 44, 46, within the top start flashing.

McCaslin, in U.S. Pat. No. 4,338,547, now expired, proposes an apparatus and method for generating light designs. Specifically, the device includes a flat motor-driven rotor 12 with a plurality of light emitting diodes 18 disposed thereon. The rotor is rotatably mounted to a base 14, and the light emitting diodes are coupled to control circuitry 38 on the base. The circuitry includes a switching network that controls when each light emitting diode is turned on or off, creating distinctive, repeatable designs as the light emitting diodes rotate. Optionally, speakers may be utilized to provide sounds corresponding to the light patterns produced by the light emitting diodes.

U.S. Pat. No. 6,589,094 to Spencer discloses a hand held light display, comprised of a handle with transparent enclosure mounted thereon. Within the transparent enclosure is a light display, with a motor that rotates the light display about the handle. Preferably, a battery powers both the light source and the rotation of the motor.

Other, similar, novelty hand-held lighting devices can be found in the following references: U.S. Pat. No. 4,338,547 to McCaslin, U.S. Pat. No. 4,713,039 to Wong, U.S. Pat. No. 6,196,693 to Glynn, U.S. Pat. No. 5,474,482 to Davidson, U.S. Pat. No. 5,105,343 to Wakimoto, U.S. Pat. No. 6,413,144 to Williams, and U.S. Published Application No. US 2002/0068505, also to Williams.

SUMMARY OF INVENTION

An object of the present invention is to provide a novelty light-up toy, which is fun to watch and creates a festive atmosphere.

Another object of the present invention is to provide a hand-held, illuminated novelty device, which creates an entertaining display of lights.

It is a further object of the present invention to provide a dynamic display of lights, utilizing at least two rotating, illuminated arms and a rotating light display within a see-through housing.

It is a further object of the present invention to provide a novelty light-up toy in which a plurality of light sources are rotated within a housing and outside the housing in such a way that creates light patterns during the rotation.

The scope and content of the present invention is not intended to be limited by or to the above mentioned objects.

Briefly, the invention is characterized in particular by the construction of a hand-held light-up toy including a see-through housing, a handle connected to the see-through housing, a light source assembly rotatably mounted within the see-through housing, the light source assembly comprising a housing and a printed circuit board mounted within the housing, a plurality of light sources mounted on the printed circuit board, a power source disposed within the handle, motor disposed within the handle and connected to the power source, having a motor shaft extending therefrom, a rotation means disposed within the handle and connected to the motor shaft, and to the printed circuit board assembly for rotating the printed circuit board assembly when the motor is turned on, and an on/off switch assessable on the handle for selectively activating the power source and the motor.

BRIEF DESCRIPTION OF THE DRAWINGS

For better understanding of the invention and additional objects and advantages thereof, reference is made to the following detailed description and accompanying drawing of a preferred embodiment, wherein

FIG. 10 is a rear perspective exploded view of the handle in accordance with the embodiment shown in FIG. 8;

DETAILED DESCRIPTION

Figure 1:
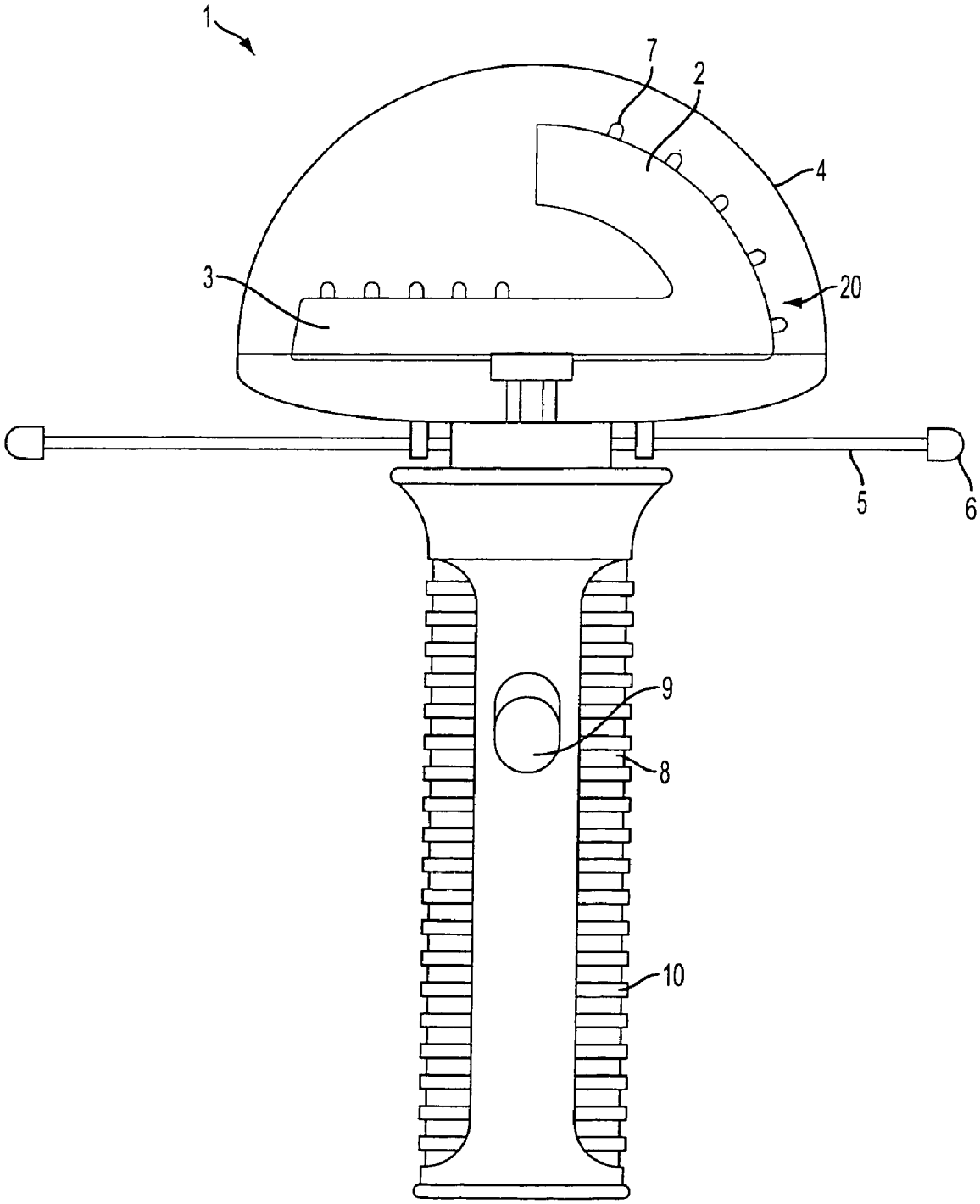
FIG. 1 is a side view of the light-up toy, in accordance with one embodiment of the present invention.
Figure 2:
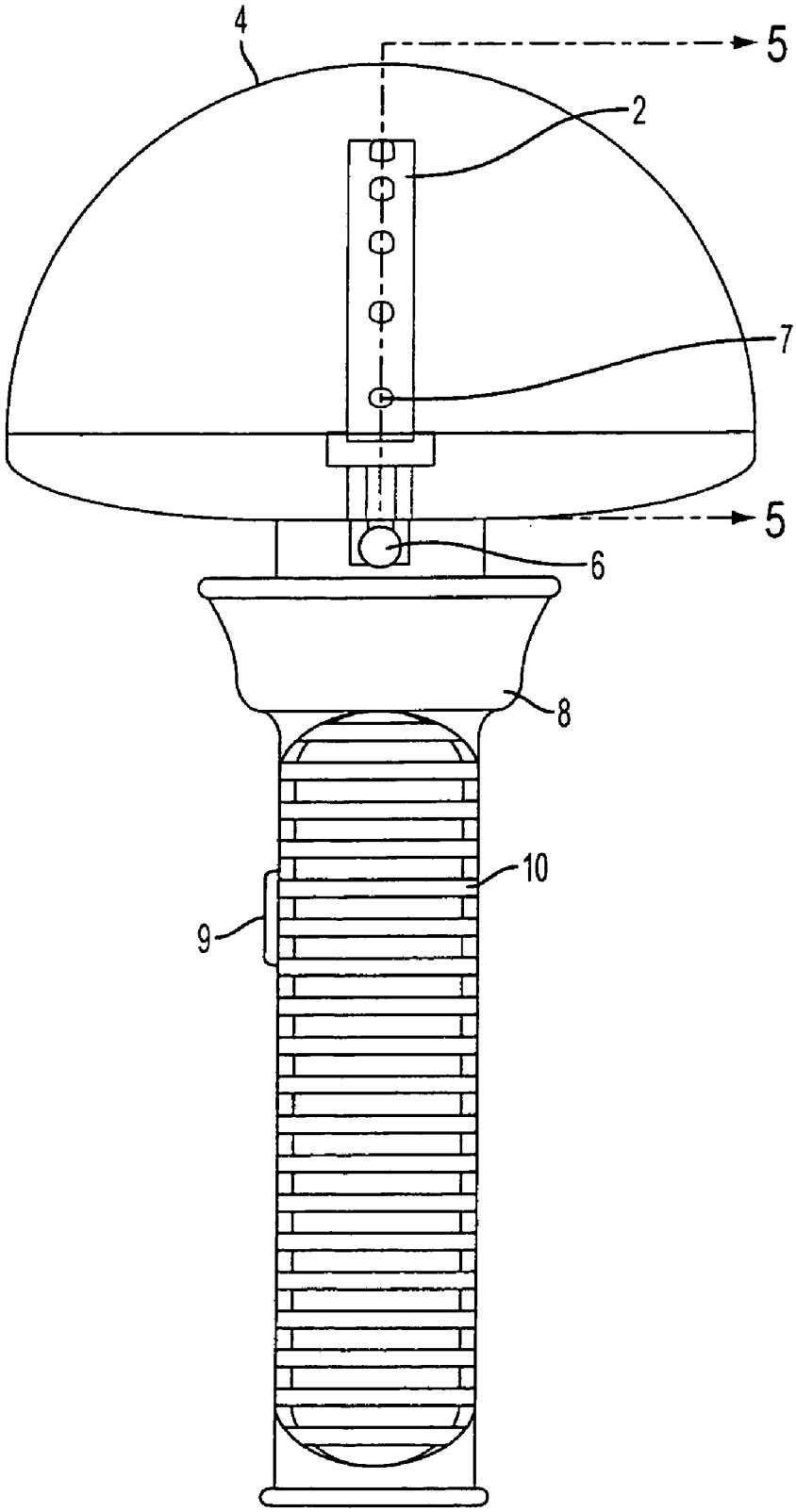
FIG. 2 is another side view of the light-up toy of FIG. 1 in accordance with one embodiment of the present invention.
Figure 3:
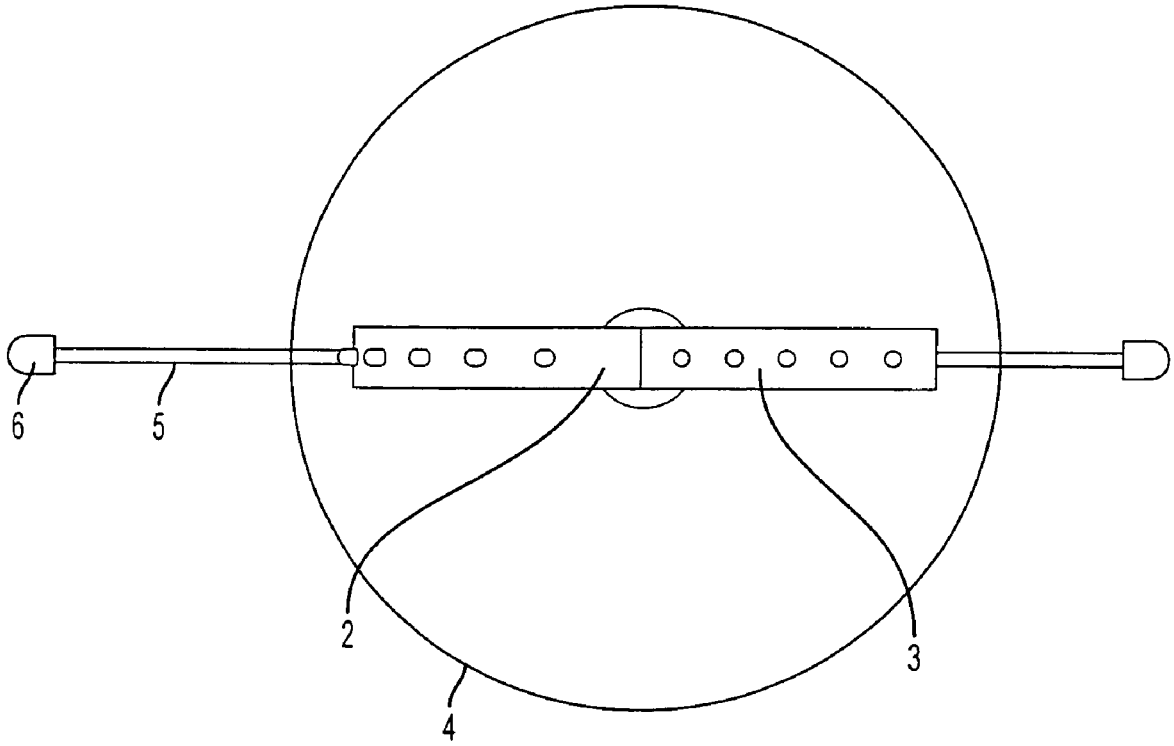
FIG. 3 is a top view of the light-up toy of FIG. 1, in accordance with one embodiment of the present invention.

The invention will be described in general with reference to FIGS. 1-7, which illustrate various embodiments of the novelty light-up toy 1 according to the present invention. Referring now in detail to the drawings, FIG. 1 illustrates a side view of the light-up toy 1, in accordance with one embodiment of the present invention, which includes a see-through housing 4 that permits a three-dimensional view of the rotating light source assembly when the toy is in use. The housing 4 can be in any desired shape, but preferably is dome-shaped. The see-through housing can be constructed of a plastic material.

Disposed within the housing 4 is a rotatably mounted light source assembly 20 comprised of a wing portion 3 and an arch portion 2 extending from one end of the wing portion 3. The light source assembly 20 comprises a printed circuit board 13 disposed therein. The printed circuit board 13 has a shape that fits within the light source assembly 20. Affixed to the printed circuit board 13 is a series of light sources 7 designed to illuminate when the light source assembly 20 rotates. The light sources 7 may be comprised of light emitting diodes, or other suitable light sources. The light sources 7 may be provided in a plurality of colors to create a colorful visual effect. The printed circuit board 13 includes an integrated circuit (IC, not shown), which includes a program to cause the light sources 7 to light up at different intensities and different intervals, causing patterns to appear in the light as the light source assembly 20 rotates. The IC is an off the shelf component, which can be purchased, for example, from MUPAC Development Ltd., in Hong Kong, China, model # MD-264.

Figure 4:
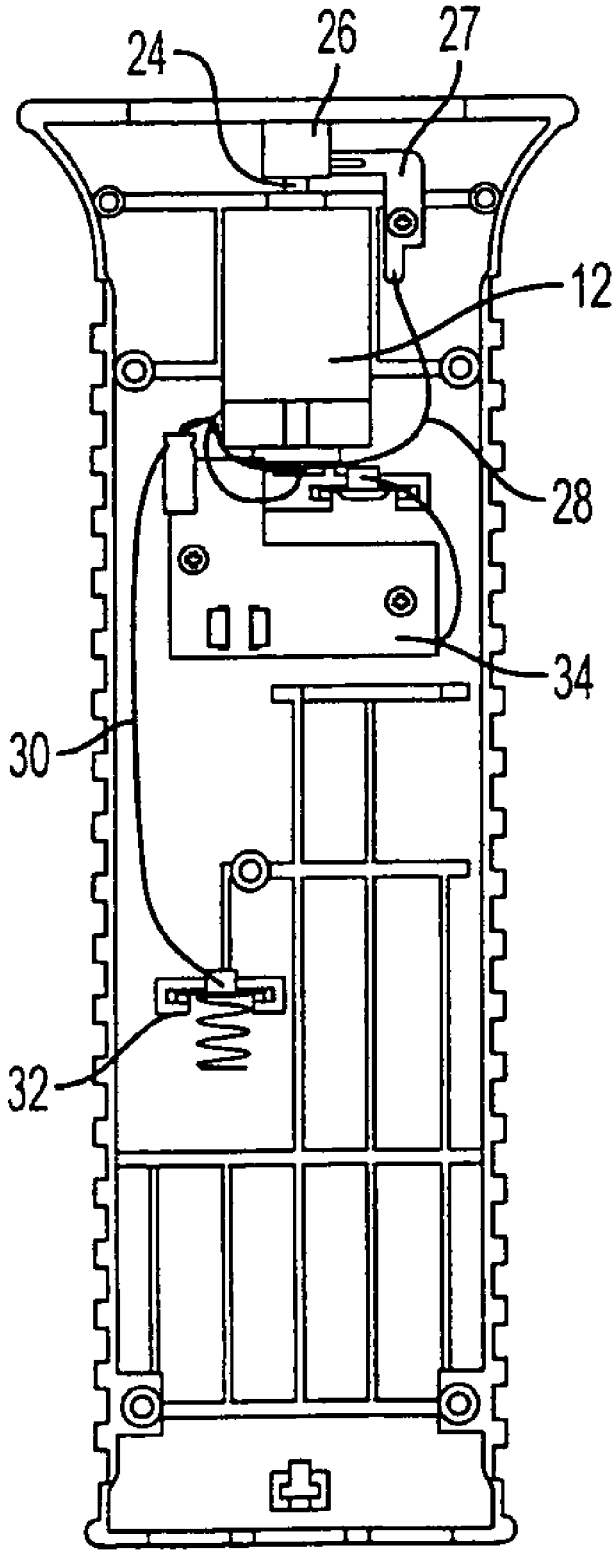
FIG. 4 provides an interior view of the handle of the light-up toy in accordance with one embodiment of the present invention.
Figure 7:
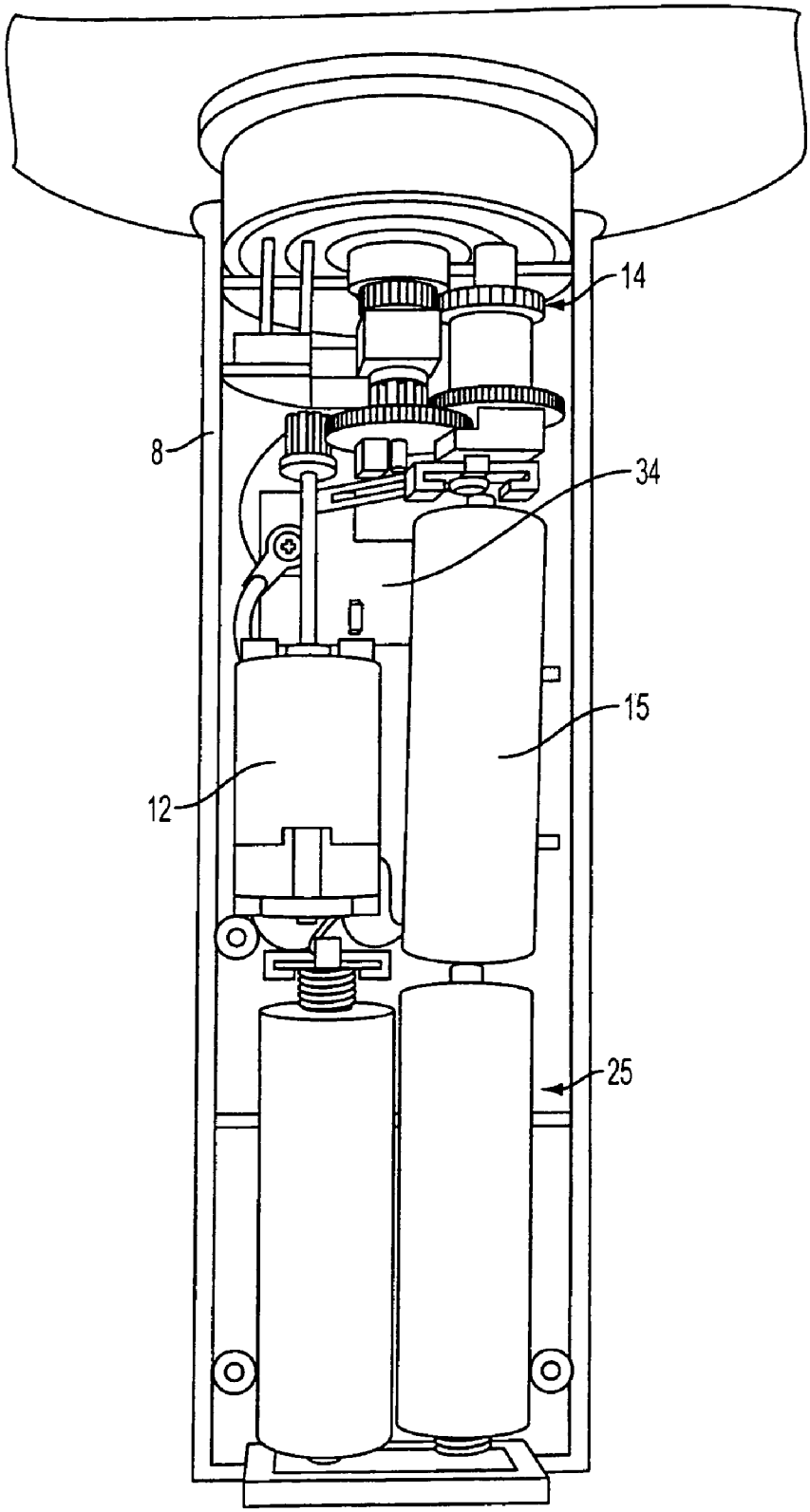
FIG. 7 provides a detailed view of the interior of the handle in accordance with another embodiment of the present invention.

An additional pair of light sources 6 is found at the ends of two flexible, rotatable arms 5. These arms 5, preferably constructed of PVC or similar flexible, or semi-flexible material, are located directly beneath the housing 4 of the toy. Disposed within the handle 8 according to the embodiments in FIGS. 4 and 7 is a printed circuit board 34, which controls operation of the motor 12. In one embodiment illustrated in FIG. 4, the light source assembly 20 is connected to the motor shaft 22, so that the light source assembly 20 rotates when the motor is turn on by the on/off switch 9. In another embodiment illustrated in FIG. 7, both the flexible arms 5 and the light source assembly 20 are connected to a series of gears 14 and a motor 12, which cause the arms 5 and light source assembly 20 to rotate upon activation of an on/off switch 9 (shown in FIG. 1). The arms 5 may be different lengths so that as the arms rotate, an oval appearance of the lights sources 6 is created.

As seen for example in FIG. 1, the on/off switch 9 is located on the handle 8 of the toy 1. The handle 8 may be further enhanced with a series of corrugated ridges 10 or other similar grip-facilitating features. The handle may be made of a rigid plastic material, or another similar suitable material.

Disposed within the handle 8 is a power source 25 for the toy 1, as well as the motor 12 that rotates the light source assembly 20 and the flexible arms 5. Preferably, the power source 25 comprises several batteries 15 (FIG. 7), although alternate sources are also possible. As shown in the embodiments of FIGS. 4 and 7, the batteries 15 are located alongside and below the motor 12. As seen most clearly in FIG. 4, wire 30 connects the motor 12 to the battery contact 32. In the embodiment shown in FIG. 4, the motor shaft 24 is connected to an armature 26, which in turn is connected to the light source assembly 20 (see, e.g., FIG. 5). The armature is connected to the motor shaft contact 27, which is in turn connected to the motor 12 via wire 28, which is in turn connected to the motor 12 via wire 28, so that the light source assembly 20 rotates when the motor is turned on by the on/off switch 9.

Alternatively, in the embodiment shown in FIG. 7, directly above and in contact with the power source 20 and motor 12 is a series of gears 14 that permit rotation of the light source assembly 20 and the flexible arms 5. The gears 14 rotate upon the user's activation of the on/off switch 9 on the exterior portion of the handle 8. Placing the switch 9 in the on position closes the circuitry connecting the batteries 15 to the motor 12. The motor 12 then causes the gears 14 to rotate, which in turn rotates the light source assembly 20 and the flexible, rotatable arms 5. Simultaneously, the light sources 7 disposed along the arch 2 and wing 3 portions of the light source assembly 20, as well as those light sources 6 at the ends of the flexible arms 5 illuminate, creating a Saturn-like light display. According to the present invention, the arms 5, the housing 4, and the light source assembly 20 all spin together at the same time. This allows for cost efficiency and also provides a unique visual effect.

According to one embodiment, the handle portion 8 holds 3 AAA batteries. However, other battery configurations are possible.

It is also a preferred embodiment of the present invention that the flexible arms 5 have a single light source 6 disposed only at their ends. The light sources 6 may be light emitting diodes or other similar devices. However, the invention also contemplates the use and placement of additional light sources 6 along the length of the flexible arms 5, or more than two arms, if a more complex lighting display pattern is desired.

Figure 5:
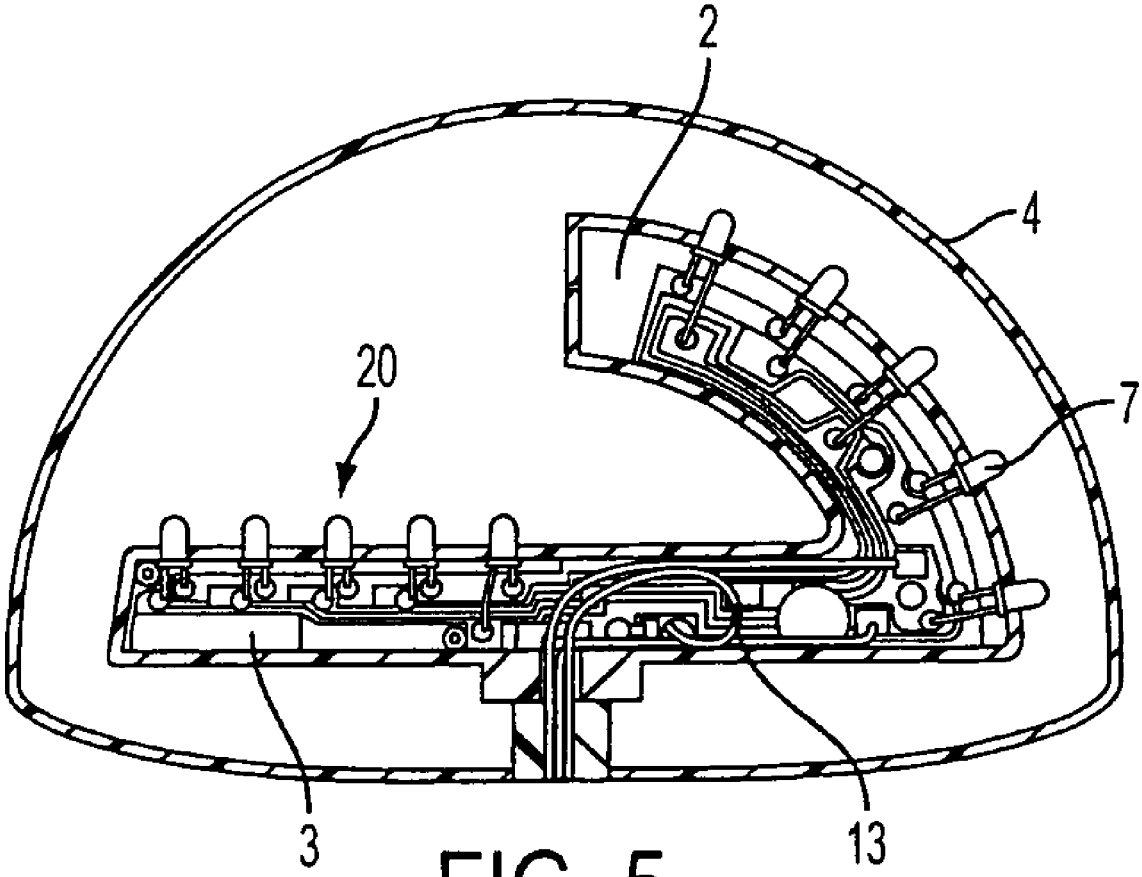
FIG. 5 is a detailed view of the see-through housing and the light source assembly contained therein, in accordance with one embodiment of the present invention.
Figure 6:
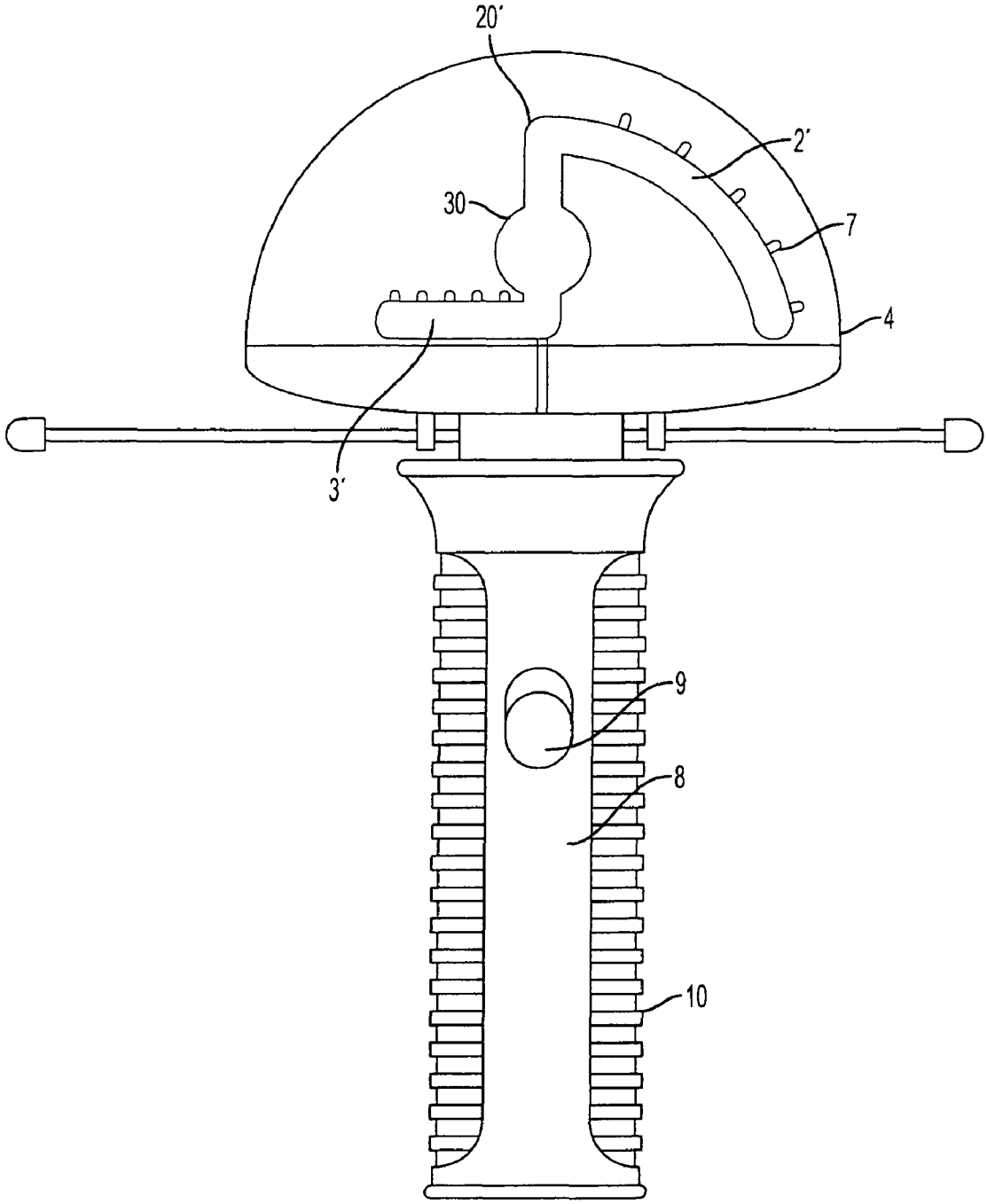
FIG. 6 provides a side view of a light-up toy having a light source assembly according to another embodiment of the present invention.

The printed circuit board 13 is shown in FIG. 5 as having a half-arch shape (arch 2), extending from a wing 3 at one end thereof. However, the "arch 2 and wing 3" configuration of the light source assembly 20 within the dome 4 may be modified. FIG. 6 is an alternative embodiment of the toy 1 in which the light source assembly 20' has a wing 3', a connecting section 30 having one end connected to one of the wing 3', and an arch 2' extending from the second end of the connecting section 30. As in the embodiment of FIG. 5, the printed circuit board (not shown) is shaped to fit within the light source assembly 20'.

Figure 8:
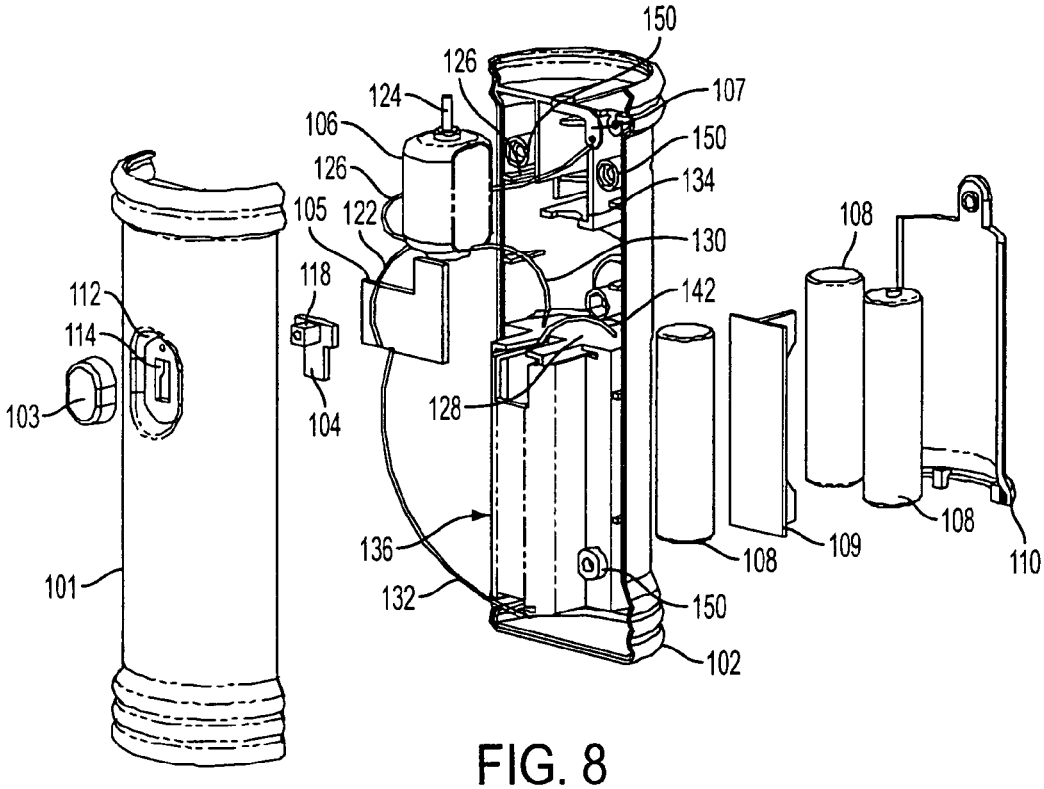
FIG. 8 is a front perspective exploded view of a handle in accordance with another embodiment of the invention.
Figure 9:
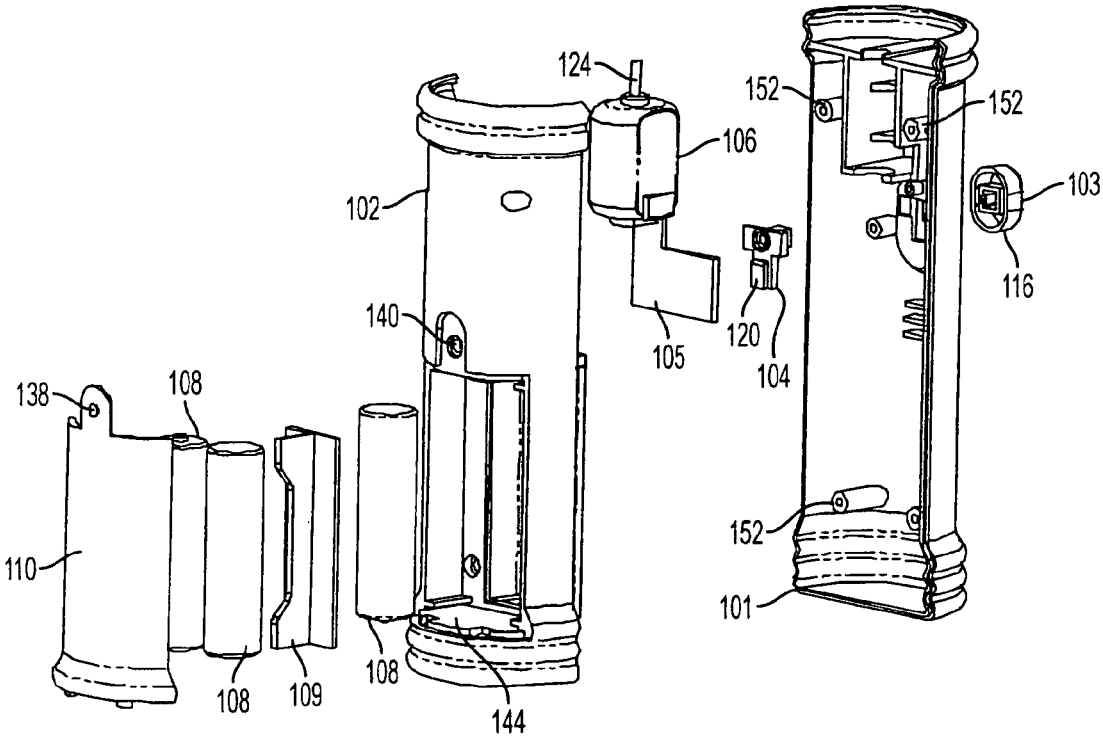

Another embodiment of the handle is shown in FIGS. 8-10. In this embodiment, the front handle body 101 includes a recess 112 in which the on/off button 103 sits. Inside the recess 112 is a through-hole 114, through which the slide switch 104 passes when the handle is assembled. The two halves of the handle body, front handle body 101 and back handle body 102 are assembled with all of the parts placed in the respective cavities (as will be described), and the handle bodies are fixed together using screws (not shown) that are inserted into the protrusions 150 and 152 and tightened until the handle is securely closed.

The slide switch 104 includes a peg 118 protruding from one side (FIG. 8) and a contact pad 120 protruding from the other side (FIG. 9). On an inner side of the button 103 is a seat 116 (FIG. 9), into which the peg 118 formed on one side of the switch 104 (FIG. 8) is inserted. The contact pad 120 comes into contact with the printed circuit board 105. The printed circuit board 105 is connected, via wire 122, to the motor 106. The motor 106 sits on motor seat 134 when the handle is assembled. The printed circuit board 105 fits in the handle between the motor 106 and a top contact plate 128.

Similarly to the embodiment shown in FIG. 4, the motor shaft 124 is connected to an armature (not shown), which in turn is connected to the light source assembly 20 (see, e.g., FIG. 5). The armature is connected to the motor shaft contact 107, which is in turn connected to the motor 106 via wire 126.

The top contact plate 128 forms the top of the battery compartment 136. A battery chamber divider 109 is provided to separate the battery compartment 136 into separate chambers, one for each battery 108. A battery door 110 is removably connected via a screw (not shown) that can be inserted and tightened in corresponding openings 138 and 140 in the battery door 110 and back handle body 102, respectively.

As seen in FIG. 8, the contact plate 128 is connected via wire 130 to the motor 106. A bottom contact plate 144 is positioned at the bottom of the battery compartment 136 and is connected via wire 132 to the printed circuit board 105. A wire 142 connects the bottom of the top contact plate 128 where one of the batteries contacts the contact plate 128, to the top of the contact plate 128. The wires 130, 132, and 142 serve to electrically connect the power source (in this case, three batteries) to the motor 106 and printed circuit board 105, so as to provide them with power when the on/off switch 103 is turned on.

Figure 10A:
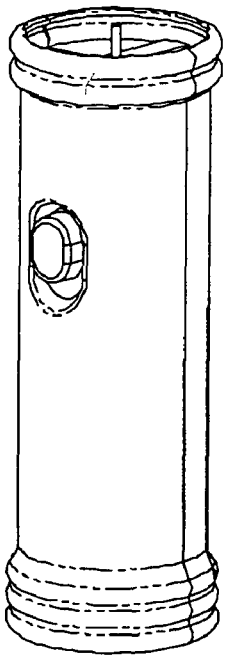
FIGS. 10A-B are perspective views of the handle in accordance with the embodiment shown in FIG. 8.
Figure 10B:
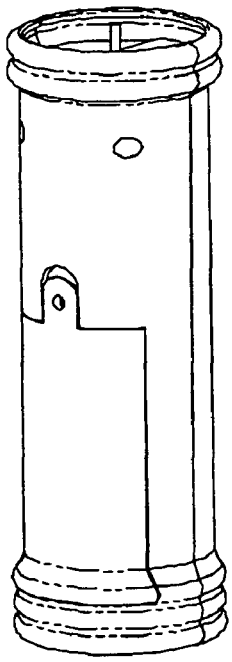
Figure 10C:
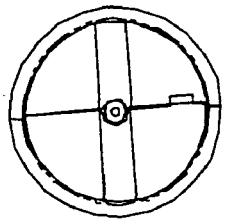
FIGS. 10C-F are plan views of the handle in accordance with the embodiment shown in FIG. 8.
Figure 10D:
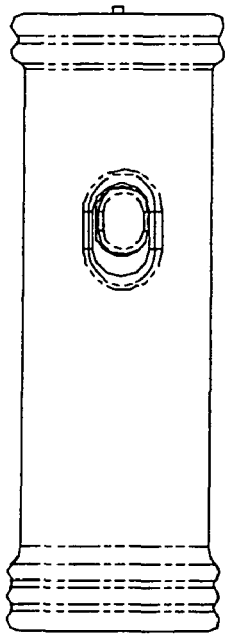
Figure 10E:
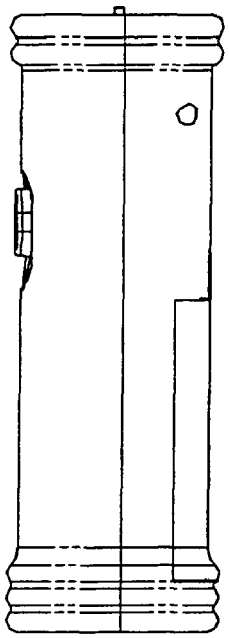
Figure 10F:
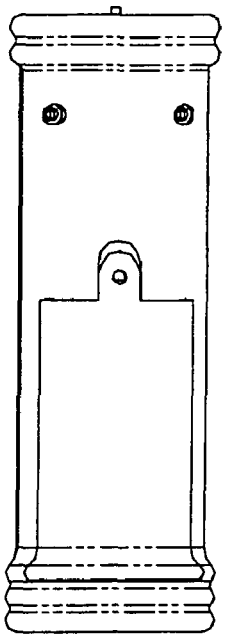

FIGS. 10A-B are perspective views of the handle in accordance with the embodiment shown in FIG. 8. FIGS. 10C-G are plan views of the handle in accordance with the embodiment shown in FIG. 8.

Although all the figures show a dome-shaped housing portion 4, it is certainly possible to utilize an alternate shape, such as a pyramid, and perhaps a transparent but colored dome 4 or pyramid, so long as the shape and color allow the user a 3-D view of the printed circuit board 13 and light sources 7. The number and placement of the light sources 6, 7 along the flexible arms 5 and printed circuit board 13, respectively, may also be modified, according to the lighting display desired.

The light source assembly 20 may be made of a rigid material, such as plastic. Decorative sheets may be adhered to the outer surface of the light source assembly 20. These sheets can be solid opaque film sheets or they could be in the form of images or patterns. In addition, without departing from the inventive design, the decorative sheets can be omitted in their entirety. In this case, during the rotation the light patterns would appear to be free floating within the housing.

Although various features of the invention have been described with particular embodiments. It is considered within one of ordinary skill in the art to mix and match the features in other embodiments not depicted in the figures.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A hand-held light-up toy comprising:

a see-through housing;

a handle connected to the see-through housing;

a light source assembly rotatably mounted within the see-through housing, the light source assembly comprising a housing and a printed circuit board mounted within the housing;

a plurality of light sources mounted on the printed circuit board;

a power source disposed within the handle;

a motor disposed within the handle and connected to the power source, having a motor shaft extending therefrom;

at least two arms rotatably mounted between the see-through housing and the handle, in which each arm comprises at least one light source;

a rotation means disposed within the handle and connected to the motor shaft, and to the at least two arms, and to the printed circuit board assembly for rotating the printed circuit board assembly and the arms when the motor is turned on; and an on/off switch assessable on the handle for selectively activating the power source and the motor.

2. The light-up toy of claim 1, wherein the power source comprises at least one battery connected to the printed circuit board to supply power to the plurality of light sources located thereon.

3. The toy of claim 1, wherein the plurality of light sources comprises a plurality of light emitting diodes.

4. The toy of claim 3, wherein the light emitting diodes are different colors.

5. The toy of claim 1, wherein the see-through housing is dome-shaped.

6. The toy of claim 1, wherein the see-through housing is constructed of a plastic material.

7. The toy of claim 1, wherein the arms are constructed of a flexible material.

8. The toy of claim 1, wherein the light source assembly comprises a wing and an arch extending from one end of the wing, and the printed circuit board is shaped so as to fit within the light source assembly, with the plurality of light sources disposed around the top portions of the wing and the arch.

9. The toy of claim 1, wherein the rotation means comprises the motor shaft, and an armature fixedly connected to the motor shaft and the light source assembly, such that when the motor shaft rotates, responsive to the motor being turned on by the switch, the light source assembly rotates.

10. The toy of claim 1, wherein the rotation means comprises the motor shaft, and a plurality of gears connected between the motor shaft and the light source assembly, such that when the motor shaft rotates, responsive to the motor being turned on by the switch, the light source assembly rotates.

11. The toy of claim 1, wherein the see-through housing is transparent but colored.

12. The toy of claim 1, wherein the arms each have a single light source disposed at the end, or the arms each have one or more light sources disposed along the length of the arm.

13. The toy of claim 1, wherein the arms have different lengths.

* * * * *